US006453862B1

(12) United States Patent
Holzmann

(10) Patent No.: US 6,453,862 B1
(45) Date of Patent: Sep. 24, 2002

(54) IGNITION DEVICE FOR PISTON-TYPE INTERNAL COMBUSTION ENGINES

(75) Inventor: Josef Holzmann, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 09/549,588

(22) Filed: Apr. 14, 2000

(30) Foreign Application Priority Data

Apr. 14, 1999 (DE) ..... 199 16 806

(51) Int. Cl.[7] ..... F02P 15/04

(52) U.S. Cl. ..... 123/162

(58) Field of Search ..... 123/162

(56) References Cited

U.S. PATENT DOCUMENTS 1,401,231 A 12/1921 Anderson

FOREIGN PATENT DOCUMENTS

| | | |
|---|---|---|
| DE | 214918 | 1/1909 |
| DE | 633611 | 7/1936 |
| DE | 634853 | 8/1936 |
| SE | WO 96/13660 | 5/1996 |

*Primary Examiner*—John Kwon
(74) *Attorney, Agent, or Firm*—Crowell & Moring LLP

(57) ABSTRACT

An ignition device for piston internal combustion engines with a moving piston electrode disposed in the piston face and a counter-electrode arranged in the cylinder head, and with a spark gap forming between the two electrodes wherein the spatial arrangement of the two electrodes is such that the spark gap is smaller than the minimum distance between the counter-electrode and the piston face.

18 Claims, 2 Drawing Sheets

IGNITION DEVICE FOR PISTON-TYPE INTERNAL COMBUSTION ENGINES

BACKGROUND AND SUMMARY OF THE INVENTION

This application claims the priority of German Application 19916806.7, filed Apr. 14, 1999, the disclosure of which is expressly incorporated by reference herein.

The invention relates to an ignition device for piston engines with a moveable piston electrode in the piston face and a counter-electrode in the cylinder head with a spark gap between them.

An ignition device is disclosed in WO 96/13660 A. It is a "spark to piston" device in which the piston electrode protrudes slightly from the piston floor and is flush with a counter-electrode approximately in the center of the combustion chamber. Such a device is not suitable especially for igniting extremely lean mixtures, since the spark gap has a minimal length only at the top dead center of the piston. In that case whether or not an ignition spark actually forms depends on various factors which differ over the entire range of operation of - the internal combustion engine. These factors include a sufficiently ignitable mixture, the working temperature, the ignition energy and the steepness of the flanks for the build-up of the secondary voltage.

The invention is addressed to the problem of creating an ignition device which will securely initiate the ignition even of extremely lean mixtures.

In accordance with the present invention, due to the short spark length in comparison to the distance of the counter-electrode from the piston bottom, the ignition energy needed for the ignition of the fuel-air mixture is substantially lower than in prior art systems. Therefore the ignition reliability is increased for the same ignition energy.

In one of the structural embodiments of the present invention, the length of the spark gap is kept approximately constant for a period that is longer than the duration of the spark. During this time the piston and counter-electrode perform a relative movement over a certain path of the counter-electrode. Therefore the moment at which ignition actually takes place can be varied within certain limits, with respect to the movement of the piston. The moment of ignition can therefore be adapted to the prevailing operating conditions.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
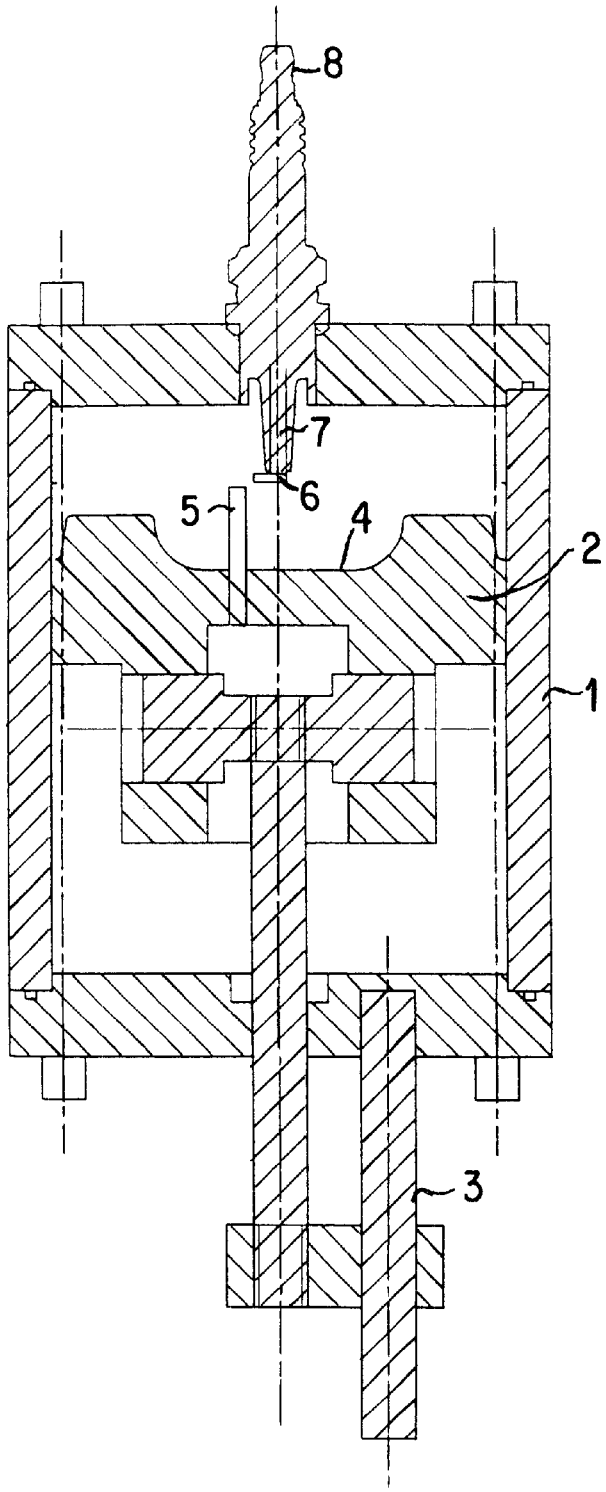
FIG. 1 illustrates a section taken through the cylinder of an internal combustion engine with a first embodiment of the ignition device of the invention.
Figure 2:
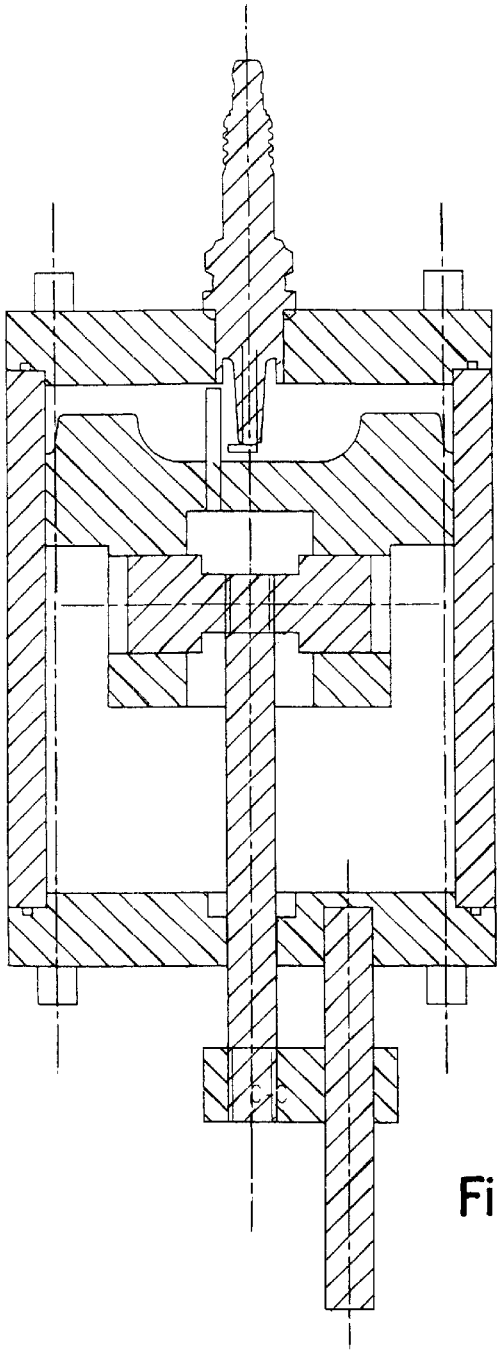
FIG. 2 is a section of FIG. 1 showing another stage of the movement of the piston.

In the embodiment shown in FIGS. 1 and 2 a piston 2 is situated in a cylinder 1 and can be driven by a driver 3. In the face 4 of the piston there is a piston electrode 5 which protrudes from the face as shown.

A counter-electrode 6 is associated with the electrode 5 and is connected by a high-voltage conductor 7 and a high-voltage terminal 8 to a spark coil which is not shown.

As seen in FIG. 2, the electrode 5 moves past the counter-electrode 6 during the movement of the piston 2. During a period before the piston 2 reaches the top dead center, as shown in FIG. 2, and clearly after this period ends, a uniform minimum distance exists between the electrodes 5 and 6. Within this minimum distance a spark forms when the high-voltage terminal 8 is properly energized, whereby it is possible to fire even with particularly lean mixtures.

Figure 3:
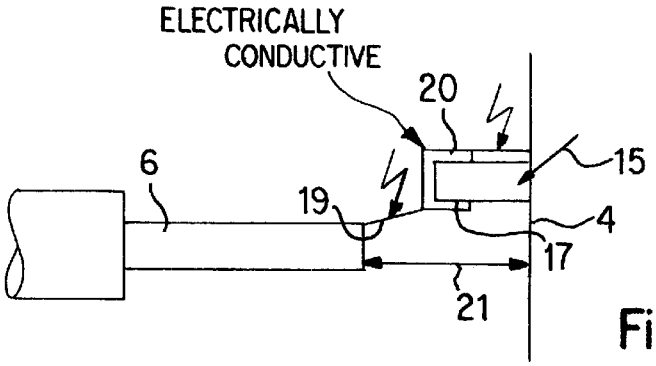
FIG. 3 is a schematic representation of a second embodiment.

In the example in FIG. 3, the piston electrode 15 is configured as a post in the piston face. It consists of an electrically conductive cap 17 resting on an insulator 18. The insulator 18 is fastened to the piston face. An ignition spark that forms between the piston face 4 and the counter-electrode 6 now overcomes two insulating sections 19 and 20, namely between the counter-electrode 6 and the cap 17 (19) on the one hand, and between the cap 17 and the piston face 4 (20). The total distance to be overcome is clearly less than the minimum distance 21 prevailing at least during the ignition between the counter-electrode 6 and the piston face 4.

An embodiment in which the counter-electrode 6 projects beyond the electrode 15 during the ignition, in a manner similar to FIG. 2, is within the scope of the invention, provided that the sum of distances 19 and 20 is less than the corresponding distance 21.

Thus, the ignition devices illustrated are especially suitable for use in internal combustion engines with direct gasoline injection, in which only an ignitable mixture is locally present.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An ignition device for a piston driven combustion engine comprising:

a piston electrode arranged in a central portion of a face of a moveable piston;

a counter-electrode arranged in a cylinder head;

wherein a distance between said counter-electrode and said piston electrode defines a spark gap which is smaller than a minimum distance between the counter-electrode and the piston face during movement of said piston.

2. The ignition device according to claim 1, wherein a minimum value of the spark gap immediately before and immediately after the ignition is substantially constant.

3. The ignition device according to claim 1, wherein the piston electrode moves laterally with respect to the counter-electrode during movement of the piston.

4. The ignition device according to claim 2, wherein the piston electrode moves laterally with respect to the counter-electrode during movement of the piston.

5. The ignition device according to claim 3, wherein the piston electrode protrudes past the counter-electrode at the top dead center position of the piston.

6. The ignition device according to claim 4, wherein the piston electrode moves past the counter-electrode at the top dead center position of the piston.

7. The ignition device according to claim 1, wherein said counter-electrode has an electrically conductive extension directed toward the piston electrode.

8. The ignition device according to claim 1, wherein the spark gap has a constant longitudinally invariable portion.

9. The ignition device according to claim 8, wherein the piston electrode is a post insulated from said piston face and made of an electrically conductive material.

10. An electrode arrangement for controlling ignition in a piston driven internal combustion engine, comprising:

a first electrode positioned in a central portion of a face of a piston;

a second electrode positioned in a cylinder head containing said piston;

wherein a distance between an end portion of the second electrode and a closest point on said first electrode defines a spark gap which is smaller than a minimum distance between the second electrode and the piston face during the entire movement of said moveable piston.

11. The arrangement according to claim 10, wherein a spacial association of the first and second electrodes provides that the minimum distance between the two electrodes immediately before and immediately after ignition is substantially constant.

12. The arrangement according to claim 10, wherein the piston electrode moves laterally with respect to the counter-electrode during piston movement.

13. The arrangement according to claim 12, wherein the piston electrode protrudes past the counter-electrode at the top dead center position of the piston.

14. The arrangement according to claim 10, wherein the second electrode has an electrically conductive extension which extends in the direction of the first electrode.

15. The arrangement according to claim 10, wherein the first electrode is formed as a post which is insulated from the piston face and is made of an electrically conductive material.

16. An electric arrangement for controlling ignition in a piston driven internal combustion engine, comprising:

a first electrode which extends perpendicularly from a face of a piston towards an inner surface of a cylinder head along a first axis;

a second electrode which extends perpendicularly from said inner surface of said cylinder head toward said piston along a second axis wherein said first and second axes are parallel and are offset by an amount which defines a gap between said first and second electrodes that is smaller than a minimum distance between the counter-electrode and the piston face during the entire movement of said moveable piston.

17. An ignition device for a piston driven combustion engine, comprising:

a first electrode positioned in a face of a piston;

a second electrode centrally positioned in a cylinder head containing said piston;

wherein a spacial association of the first and second electrodes provides that the minimum distance between the two electrodes immediately before and immediately after ignition of said engine is substantially constant.

18. The ignition device according to claim 17, wherein the first electrode is formed as a post which is insulated from the piston face and is made of an electrically conductive material.

* * * * *